US006661394B1

(12) United States Patent
Choi

(10) Patent No.: US 6,661,394 B1
(45) Date of Patent: Dec. 9, 2003

(54) DRIVING CIRCUIT FOR RADIO FREQUENCY PLASMA DISPLAY PANEL

(75) Inventor: Jeong Pil Choi, Suwon-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/551,593

(22) Filed: Apr. 17, 2000

(30) Foreign Application Priority Data

Apr. 17, 1999 (KR) ..... 1999-13705
Jun. 3, 1999 (KR) ..... 1999-20549

(51) Int. Cl.[7] ..... G09G 3/28

(52) U.S. Cl. ..... 345/60; 345/62; 345/63; 345/65; 345/66; 345/67; 345/204; 345/214; 345/690; 313/484; 313/514; 315/169.4; 315/167

(58) Field of Search ..... 345/60, 62, 63, 345/65, 66, 67, 204, 690, 214; 315/169.4, 167; 313/484, 514

(56) References Cited

U.S. PATENT DOCUMENTS 4,924,191 A * 5/1990 Erb et al. ..... 330/130
5,400,086 A * 3/1995 Sano et al. ..... 348/678
6,064,348 A * 5/2000 Cosenza et al. ..... 343/770
6,167,169 A * 12/2000 Brinkman et al. ..... 385/4
6,264,805 B1 * 7/2001 Forrest et al. ..... 204/192.26
6,424,232 B1 * 7/2002 Mavretic et al. ..... 333/17.3
6,483,489 B1 * 11/2002 Yoo et al. ..... 345/60

OTHER PUBLICATIONS

Valery A. Godyak, Robert . Piejak and Natalia Sternberg; A Comparison of RF Electode Sheath Models IEEE Transactions on Plasma Science, vol. 21, No. 4, Aug. 1993.*

M. Shiratani, N. Kishigaki, H. Kawasaki T. Fukuzuwa and Y. Watanabe; Two–Dimensional Spatial Profiles of Size and Densi of Particulates Grown in RF Silane Plasmas; IEEE Transactions on Plasma Science vol. 24 No. 1, Feb. 1996.*

M. Shiratani, T. Fukuzawa and Y Watanabe; Formataion Processes of Parfticulates in Helium–Diluted Silane RF Plasmas; IEEE Transactions on Plasma Science, vol. 22, No. 2, Apr. 1994.*

* cited by examiner

*Primary Examiner*—Bipin Shalwala
*Assistant Examiner*—Vincent E. Kovalick
(74) *Attorney, Agent, or Firm*—Fleshner & Kim, LLP

(57) ABSTRACT

A driving circuit for a radio frequency plasma display panel that is capable of effectively making an impedance matching between a radio frequency signal generator and a panel. In the circuit, radio frequency electrode lines are divided into a plurality of groups. A plurality of impedance matchers are independently connected to each group of the radio frequency electrode lines to match impedance of input and output terminals thereof. Accordingly, an impedance difference between the radio frequency electrode lines caused by a length difference of radio frequency supply lines is uniformly compensated, so that a maximum power of radio frequency signal can be applied to each radio frequency electrode line to provide a stable operation of the panel as well as to improve a picture quality.

19 Claims, 9 Drawing Sheets

| TIME | 1 F | 2 F | 3 F | 4 F |
|---|---|---|---|---|
| LEVEL | $M_L$ | $H_L$ | $L_L$ | $H_L$ |
| MATCHING VALUE | $M_M$ | $H_M$ | $L_M$ | $M_M$ |

DRIVING CIRCUIT FOR RADIO FREQUENCY PLASMA DISPLAY PANEL

BACKGROUND OF THE INVENTION

1. Field of the Invention

This invention relates to a plasma display panel (PDP) using a radio frequency discharge, and more particularly to a driving circuit for a radio frequency PDP that is capable of effectively matching an impedance between a radio frequency signal generator and the plasma display panel.

2. Description of the Related Art

Recently, a plasma display panel (PDP) feasible to the fabrication of large-scale panel has been available for a flat panel display device. The PDP includes discharge cells corresponding to color pixels of matrix type and controls a discharge interval of each discharge cell to display a picture. More specifically, after the PDP selected discharge cells to be displayed by an address discharge, it allows a discharge to be maintained in a desired discharge interval at the selected discharge cells. Thus, in the discharge cells, a vacuum ultraviolet ray generated during the sustaining discharge radiates a fluorescent material to emit a visible light. In this case, the PDP controls a discharge-sustaining interval, that is, a sustaining discharge frequency of the discharge cells to implement a gray scale required for an image display. As a result, the sustaining discharge frequency becomes an important factor for determining the brightness and a discharge efficiency of the PDP. For the purpose of performing such a sustaining discharge, a sustaining pulse having a frequency of 200 to 300 kHz and a width of about 10 to 20 $\mu$s has been used in the prior art. However, the sustaining discharge is generated only once at a extremely short instant per the sustaining pulse by responding to the sustaining pulse; while it is wasted for a step of forming a wall charge and a step of preparing the next sustaining discharge at the remaining major time. For this reason, the conventional three-electrode, face-discharge, and AC PDP has a problem in that, since a real discharge interval is very short in comparison to the entire discharge interval, the brightness and the discharge efficiency become low.

In order to solve such a problem of low brightness and low discharge efficiency, we has suggested a method of utilizing a radio frequency discharge employing a radio frequency signal of hundreds of MHz as a display discharge. In the case of the radio frequency discharge, electrons perform an oscillating motion by the radio frequency signal to sustain the display discharge in a time interval when the radio frequency signal is being applied. More specifically, when a radio frequency signal with a continuously alternating polarity is applied to any one of the two opposite electrodes, electrons within the discharge space are moved toward one electrode or the other electrode depending on the polarity of the voltage signal. If the polarity of a radio frequency voltage signal having been applied to the electrode before the electrons arrive at the electrode is changed when electrons are moved into any one electrode, then the electrons has a gradually decelerated movement speed in such a manner to allow their movement direction to be changed toward the opposite electrode. The polarity of the radio frequency voltage signal having been applied to the electrode before the electrons within the discharge space arrive at the electrode is changed as described, so that the electrons make an oscillating motion between the two electrodes. Accordingly, when the radio frequency voltage signal is being applied, the ionization, the excitation and the transition of gas particles are continuously generated without extinction of electrons. The display discharge is sustained during most discharge time, so that the brightness and the discharge efficiency of the PDP can be improved. Such a radio frequency discharge has the same physical characteristic as a positive column in a glow discharge structure.

FIG. 1 is a perspective view showing the structure of a discharge cell of the above-mentioned radio frequency PDP employing a radio frequency discharge. In FIG. 1, the discharge cell 26 includes radio frequency electrodes 12 provided on an upper substrate 10, data electrodes 16 and scanning electrodes 20 provided on a lower substrate 14 in such a manner to be perpendicular to each other, and barrier ribs 22 provided between the upper substrate 10 and the lower substrate 14. The radio frequency electrodes 12 apply a radio frequency signal. The data electrodes 18 apply a data pulse for selecting cells to be displayed. The scanning electrodes 20 are provided in opposition to the radio frequency electrodes 12 in such a manner to be used as opposite electrodes of the radio frequency electrodes 12. Between the data electrodes 18 and the scanning electrodes 20 is provided a dielectric layer 18 for the charge accumulation and the isolation. The barrier ribs 22 shut off an optical interference between the cells. In this case, the barrier ribs 22 are formed into a lattice structure closed on every side for each discharge cell so as to isolate the discharge space. This is because it is difficult to isolate a plasma for each cell unlike the existent face-discharge due to the opposite discharge generated between the radio frequency electrodes 12 and the scanning electrodes 20. Also, the barrier ribs 22 have a more enlarged height than the conventional barrier ribs for the sake of providing a smooth radio frequency discharge between the scanning electrodes 20 and the radio frequency electrodes 12. A fluorescent material 24 is coated on the surface of the barrier rib 22 to emit a visible light with an inherent color by a vacuum ultraviolet ray generated during the radio frequency discharge. The discharge space defined by the upper substrate 10, the lower substrate 14 and the barrier ribs 22 is filled with a discharge gas.

As shown in FIG. 2, the discharge cells 26 having the configuration as described above are positioned at each intersection among data electrode lines X1 to Xm, scanning electrode lines Y1 to Yn and radio frequency electrode lines RF. In FIG. 2, the data electrode lines X1 to Xm consist of the data electrodes 16 of the discharge cells 26. The scanning electrode lines Y1 to Yn consist of the scanning electrodes 20, and the radio frequency electrode lines RF consist of radio frequency electrodes 12. A driving method of the discharge cell 26 of FIG. 1 will be described below. A data pulse DP is applied to the address electrode 16 and a scanning pulse SP is applied to the scanning electrode 20 to generate an address discharge. By this address discharge, charged particles are produced at a discharge space. The charged particles make a radio frequency discharge with the aid of a radio frequency pulse RFS applied to the radio frequency electrode 12 and a center voltage Vc of a radio frequency voltage applied to the scanning electrode 20 constantly. In this case, an ultraviolet ray generated by the radio frequency discharge radiates a fluorescent material 24 to emit a visible light. When an erasure pulse is applied to the scanning electrode 20, the charged particles becomes distinct to stop the radio frequency discharge.

In order to cause a radio frequency discharge from the radio frequency PDP including the discharge cells as described above, a radio frequency signal having a sufficient power must be applied to radio frequency electrode lines RF of the panel. A conventional PDP driving circuit including a radio frequency driving circuit for obtaining this purpose is shown in FIG. 3.

Referring to FIG. 3, the conventional radio frequency PDP driving circuit includes an analog to digital (A/D) converter 30 for converting an input analog image signal into a digit signal, an image signal processor 32 for converting the digit signal from the A/D converter 30 into a bit signal to re-arrange the same for each bit, a data driver 34 for outputting a driving signal according to a data signal inputted from the image signal processor 32 to data electrode lines of a PDP 42, a radio frequency generator 36 for generating a radio frequency signal, an amplifier 38 for amplifying and outputting the radio frequency signal from the radio frequency generator 36, an impedance matcher 40 for matching impedance of the amplifier 38 with that of the PDP 42, and a scanning driver for driving scanning electrode lines of the PDP 42. The A/D converter 30 converts an input analog image signal into a digit signal and outputs it. The image signal processor 32 converts the digit signal inputted from the A/D converter 30 into a bit signal to re-arrange the bit signal for each bit in compliance with a driving of the PDP 42 and output it. The data driver 34 applies a driving signal according to an image data inputted from the image signal processor 32 to the data electrode lines of the PDP 42. The radio frequency generator 36 generates a radio frequency signal to apply it to the amplifier 38. The amplifier 38 amplifies the radio frequency signal from the radio frequency generator 36 into a power enough to cause a radio frequency discharge to output the same to the impedance matcher 40. The impedance matcher 40 matches impedance of the amplifier 38 with that of the panel 42 to apply a maximum power of radio frequency signal to the radio frequency electrode lies of the panel 42. The scanning driver 44 applies a scanning signal to the scanning electrode lines of the PDP 42. Basically, the panel 42 has a capacitance. In this case, if a radio frequency discharge is generated at the panel 42, then a phenomenon of increasing a capacitance of the panel occurs because a sheath is produced at a radio frequency electrode causing the radio frequency discharge and a scanning electrode to narrow a distance between the two electrodes determining a capacitance value. Thus, impedance of the panel is reduced to absorb (or pass) the radio frequency signal within the panel 42, so that a power of the radio frequency signal applied to the panel 42 is reduced. Therefore, the impedance matcher 40 for matching impedance between the radio frequency amplifier 38 and the panel 42 is one of important elements in the radio frequency driving circuit. This is because a maximum power of radio frequency signal is applied to the panel 42 when impedance of the radio frequency amplifier 38 becomes equal to that of the panel 42 so that the panel 42 can be stabbly driven. Generally, an incident wave and a reflective wave co-exists in the radio frequency driving circuit. In real, a power superposed with an incident wave and a reflective wave is applied to the panel 42. Accordingly, the application of a maximum power of radio frequency signal by the impedance matching at the impedance matcher 40 means that an incident wave is applied to the panel 42 as it is, with making a minimum reflective wave.

To this end, as shown in FIG. 4, the impedance matcher 40 includes a first capacitor C1 connected between a first node N1 at the output terminal of the amplifier 38 and a ground, and a serial connection of a second capacitor C2 and an inductor L between the first node N1 and the input terminal of the panel 42. By values of the first and second capacitors C1 and C2 and the inductor L, impedance matching between the amplifier 38 and the panel 42 is made. In this case, the first and second capacitors C1 and C2 and the inductor L are fixedly designed to have optimum values depending on impedance of the panel 42 and a characteristic of the entire system in the PDP.

One of important parameters in making an impedance matching at such an impedance matcher 40 is a length of a radio frequency supply line connected to the impedance matcher 40 and each radio frequency electrode line of the panel 42. The PDP has being developed for the purpose of providing a large-scale display of more than 40 inch that requires a length of more than at least 50 to 60 Cm on the basis of a distance between the top and the bottom of the panel. In other words, a top-to-bottom length of the panel in the large-scale PDP requires a length of tens of to hundreds of Cm. In such a PDP having the panel length of tens of to hundreds of Cm, however, a length difference of several to tens of Cm is generated between the radio frequency supply lines connected to the matcher 40 and each radio frequency electrode lines of the large-scale panel 42. Since impedance is changed due to such a length difference of the radio frequency supply lines to apply radio frequency signals with a different power to each radio frequency electrode line, the PDP fails to make a stable radio frequency discharge.

Referring now to FIG. 5, there is shown a panel 42 including radio frequency electrode lines RF1 to RFn connected commonly to the conventional impedance matcher 40. As seen from FIG. 5, when a single of impedance matcher 40 for making an impedance matching exists, the length of supply lines a connected to each radio frequency electrode line RF1 to RFn becomes different wherever the impedance matcher 40 is positioned. Particularly, when the panel 42 is made into a large-scale, a length difference in each supply line a becomes more than several to tens of Cm. If the radio frequency supply lines a have such a difference, particularly, a difference of more than tens of Cm, then a considerably large impedance difference is generated. This results in an impedance difference being generated between the radio frequency electrode lines RF1 to RFn. In particular, when the impedance matcher 40 is located at the center in the upward and downward direction of the panel 42, a length difference between the supply line a connected to the (n/2)th radio frequency electrode line RFn/2 positioned at the center of the panel 42 and the supply line a connected to the first or nth radio frequency electrode line RF1 or RFn, that is, an impedance difference therebetween is particularly large. Since impedance between the radio frequency electrode lines RF1 to RFn becomes different due to such a length difference of the radio frequency supply lines a to supply a different power of radio frequency signal in spite of the same load, that is, the same radio frequency electrode, a stable radio frequency discharge can not be obtained. Also, since a different magnitude of radio frequency signal is applied to each radio frequency electrode line RF1 to RFn due to an impedance difference according to a length difference of the radio frequency supply lines a, an intensity of light occurred by discharge becomes non-uniform to distort a picture. These problems become more serious as the radio frequency is higher and the size of the panel 42 is larger, the more is serious.

Meanwhile, in order to make a matrix driving of the panel 42, each discharge cell must be independently driven and, at the same time, a radio frequency signal with an constant level must be applied to the panel 42. When a radio frequency signal is reduced by discharge cells generating a radio frequency discharge, however, a sufficient power of radio frequency signal is not applied to discharge cells in which a radio frequency discharge is to be generated after that time, so that the radio frequency discharge may not cause in the discharge cells.

More specifically, impedance of the panel 42 is varied by inputted signal to be displayed. For instance, it is assumed that, when only image signals having a black level are inputted, that is, when a radio frequency discharge does not occur, impedance of the panel 42 is the smallest value $Z_{MIN}$. Also, it is assumed that, when image signal expressing a white level only are inputted, that is, when a radio frequency discharge is generated continuously during one frame at the entire panel 42, impedance of the panel 42 is the largest value $Z_{MAX}$. In this case, it can be said that all of the impedance values which the panel 42 can have correspond to a value between $Z_{MIN}$ and $Z_{MAX}$. Accordingly, a method of assuming impedance of the panel 42 to be a intermediate value between $Z_{MIN}$ and $Z_{MAX}$ in correspondence with variable impedance of the panel 42 and matching impedance of the radio frequency amplifier 38 with that impedance has been applied to the conventional impedance matcher 40.

However, since the conventional impedance matcher 40 can not cope with an impedance variation of the panel 42 adaptively, it is difficult to apply a maximum power of radio frequency signal to the panel 42. First of all, it is important to supply a constant radio frequency signal for a momentarily changing image signal when a moving picture is displayed on the panel 42. Since the conventional impedance matcher 40 having a fixed impedance value fails to adaptively cope with an impedance variation of the panel 42 so that a maximum power of radio frequency signal can not be applied to the PDP 42, however, it is difficult to generate a stable radio frequency discharge at the panel 42.

SUMMARY OF THE INVENTION

Accordingly, it is an object of the present invention to provide a radio frequency driving circuit wherein an impedance difference between radio frequency electrode lines caused by a length difference of radio frequency supply lines is compensated to make a stable driving of a radio frequency PDP.

A further object of the present invention is to provide a radio frequency driving circuit that is capable of adjusting to impedance of a PDP varied in accordance with a brightness level of an image signal so as to supply a maximum power of radio frequency signal.

In order to achieve these and other objects of the invention, a radio frequency PDP driving circuit according to one aspect of the present includes a plurality of impedance matching means, being independently connected to each group of radio frequency electrodes, to match impedance of input and output terminals, said radio frequency electrodes being divided into a plurality of groups.

A radio frequency PDP driving circuit according to another aspect of the present includes impedance matching means for varying an impedance matching value in accordance with an input control signal to match impedance between an input terminal to which a radio frequency signal is applied and the panel; and control means for generating said control signal to set an impedance matching level in accordance with a brightness level of an input image signal and to control an impedance matching value of the impedance matching means in accordance with the impedance matching level.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
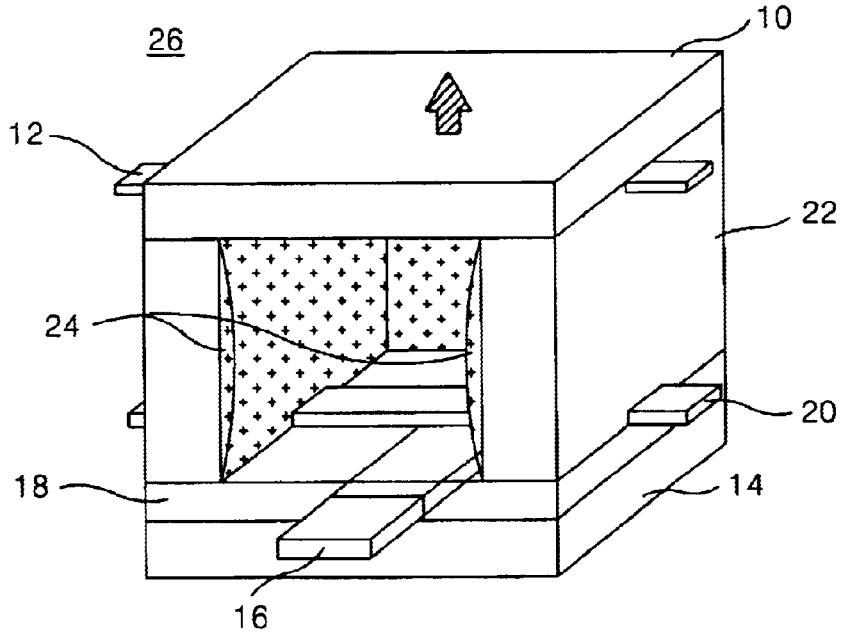
FIG. 1 RELATED ART
FIG. 1 is a perspective view showing the structure of a discharge cell of the conventional radio frequency PDP.
Figure 2:
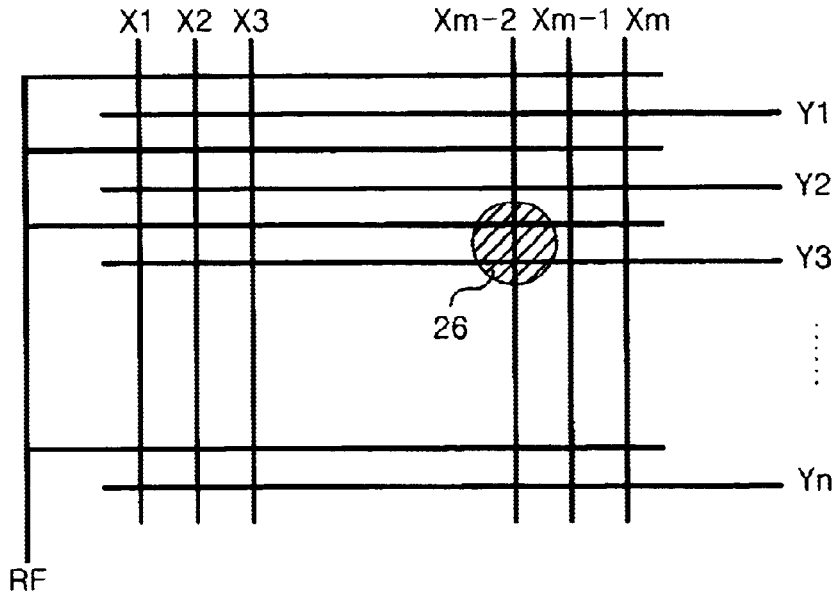
FIG. 2 RELATED ART
FIG. 2 shows an entire electrode arrangement of a radio frequency PDP including the discharge cell of FIG. 1.
Figure 3:
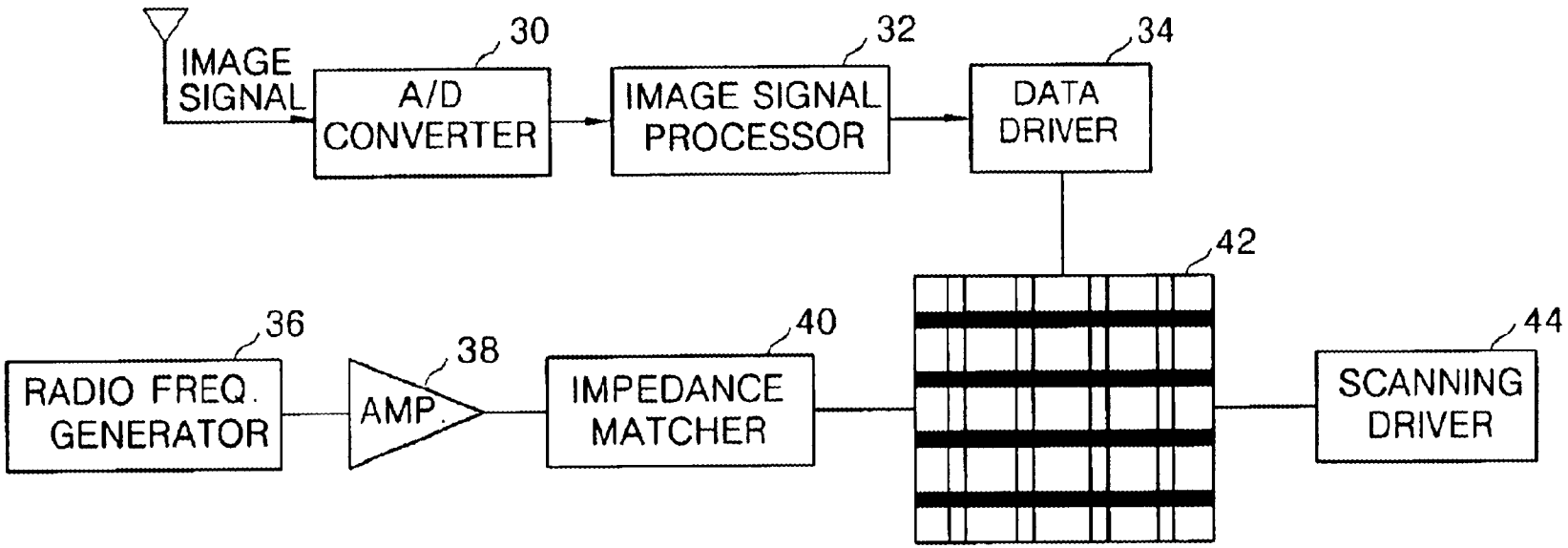
FIG. 3 RELATED ART
FIG. 3 is a block diagram showing the configuration of a radio frequency driving circuit in the conventional radio frequency PDP.
Figure 4:
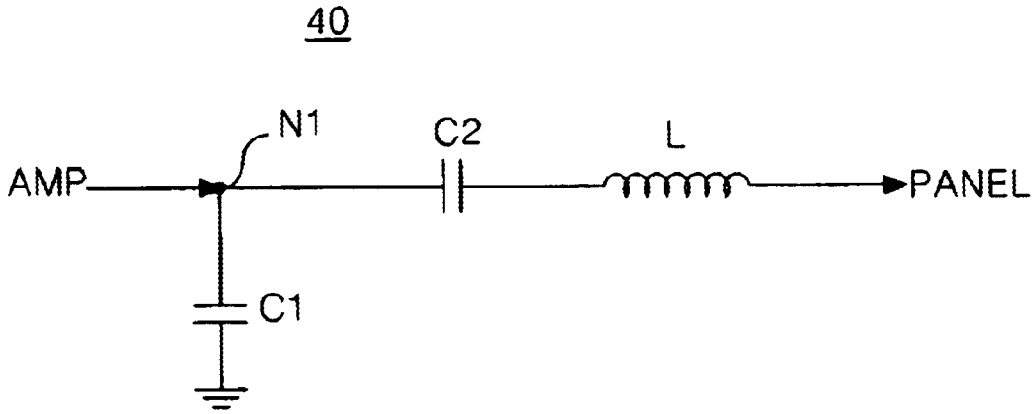
FIG. 4 RELATED ART
FIG. 4 is a detailed circuit diagram of the impedance matcher shown in FIG. 3.
Figure 5:
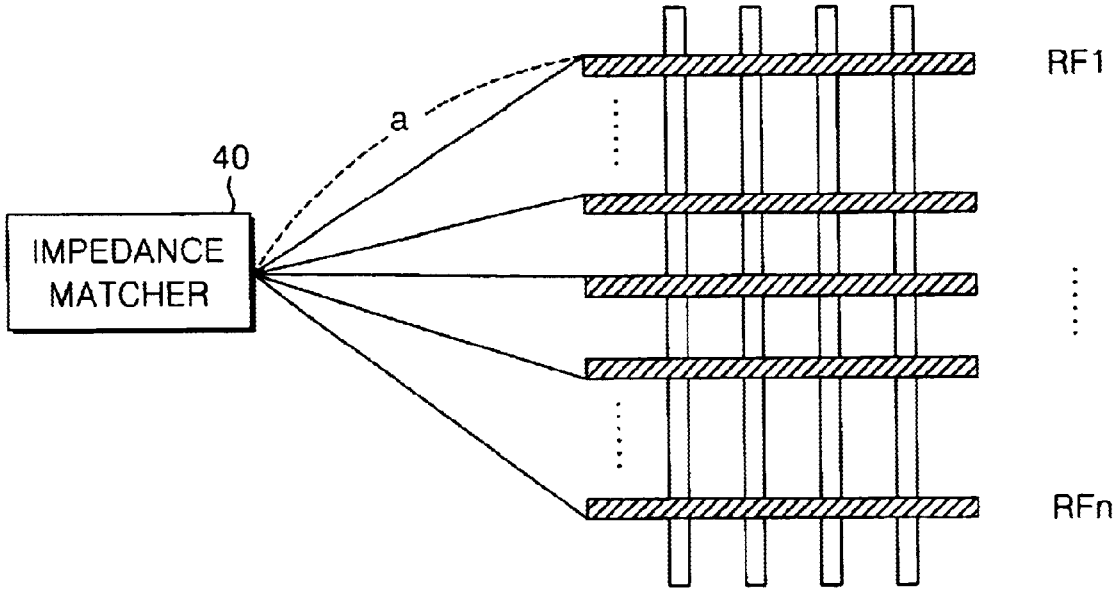
FIG. 5 RELATED ART
FIG. 5 is a view for representing a length difference in supply lines between the impedance matcher in FIG. 3 and radio frequency electrode lines.
Figure 6:
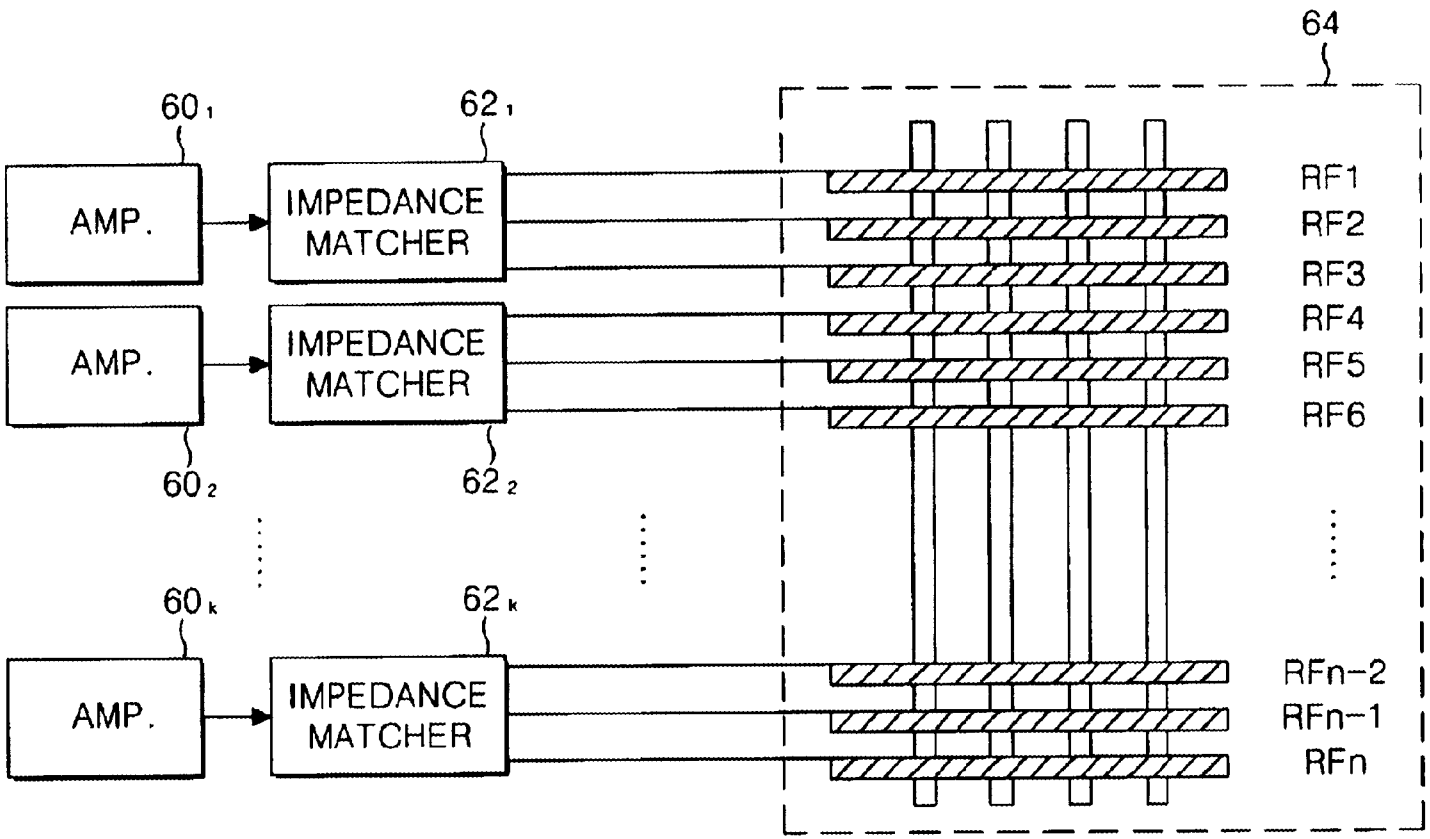
FIG. 6 is a block diagram showing the configuration of a driving circuit in a PDP according to an embodiment of the present invention.

Referring to FIG. 6, there is shown a radio frequency driving circuit in a PDP according to an embodiment of the present invention. The radio frequency driving circuit includes k amplifiers $\mathbf{60}_1$ to $\mathbf{60}_k$, k impedance matchers $\mathbf{62}_1$ to $\mathbf{62}_k$ connected to each of the amplifiers $\mathbf{60}_1$ to $\mathbf{60}_k$, and a panel 64 having n radio frequency electrode lines RF1 to RFn, a group in plurality number of which is connected to the respective k impedance matchers $\mathbf{62}_1$ to $\mathbf{62}_k$. In the panel 64, the n radio frequency electrode lines RF1 to RFn arranged to include each scanning line are grouped into k adjacent electrode lines in plurality number, for example, three by three, and each of the k radio frequency electrode line group is connected to the k impedance matchers $\mathbf{62}_1$ to $\mathbf{62}_k$. As the radio frequency driving circuit includes the k impedance matchers $\mathbf{62}_1$ to $\mathbf{62}_k$ as mentioned above, the length of radio frequency supply lines b connected between each impedance matcher $\mathbf{62}_1$ to $\mathbf{62}_k$ and each radio frequency electrode lines RF1 to RFn almost have not a difference. Thus, an impedance difference caused by a length difference in the radio frequency supply lines b is not generated, so that a radio frequency signal can be uniformly applied to each radio frequency electrode line RF1 to RFn. Independent amplifiers $\mathbf{60}_1$ to $\mathbf{60}_k$ are connected to the k impedance matchers $\mathbf{62}_1$ to $\mathbf{62}_k$, respectively. Each of the k impedance matchers $\mathbf{62}_1$ to $\mathbf{62}_k$ amplifies a radio frequency signal inputted from a radio frequency generator (not shown) and outputs it to the respective impedance matchers $62_1$ to $62_k$ connected to each of them. Each of the k impedance matchers $62_1$ to $62_k$ matches impedance between each amplifier $60_1$ to $60_k$ and each radio frequency electrode line RF1 to RFn to always apply a maximum power of radio frequency signal to each radio frequency electrode line RF1 to RFn. In this case, the n radio frequency electrode lines RF1 to RFn are distributed into the k amplifiers $60_1$ to $60_k$ and the k impedance matchers $62_1$ to $62_k$ to reduce a load quantity at each of the amplifiers $60_1$ to $60_k$ and the impedance matchers $62_1$ to $62_k$. Accordingly, the k amplifiers $60_1$ to $60_k$ and the k impedance matchers $62_1$ to $62_k$ have a reduction in the number of driving radio frequency electrode lines to provide a better voltage variation ratio to that extent, so that the circuit can obtain a stable operation. For instance, it is assumed that a power of 100 W is required when the entire radio frequency electrode lines RF1 to RFn are driven with a single amplifier 38 and a single impedance matcher 40 as shown in FIG. 3 in the VGA (640×480) size. In this case, if the radio frequency electrode lines RF1 to RFn are distributed into ten groups to include ten amplifiers and ten impedance matchers in the present invention, then the present invention requires to supply only 10 W to each of the 10 amplifiers, so that it becomes easy to adjust a unit amplifier. Also, a driving voltage of the radio frequency electrode lines RF1 to RFn is independent from each group, so that each of the impedance matchers $62_1$ to $62_k$ can be more easily adapted for a load variation changed rapidly like a moving picture.

Figure 7:
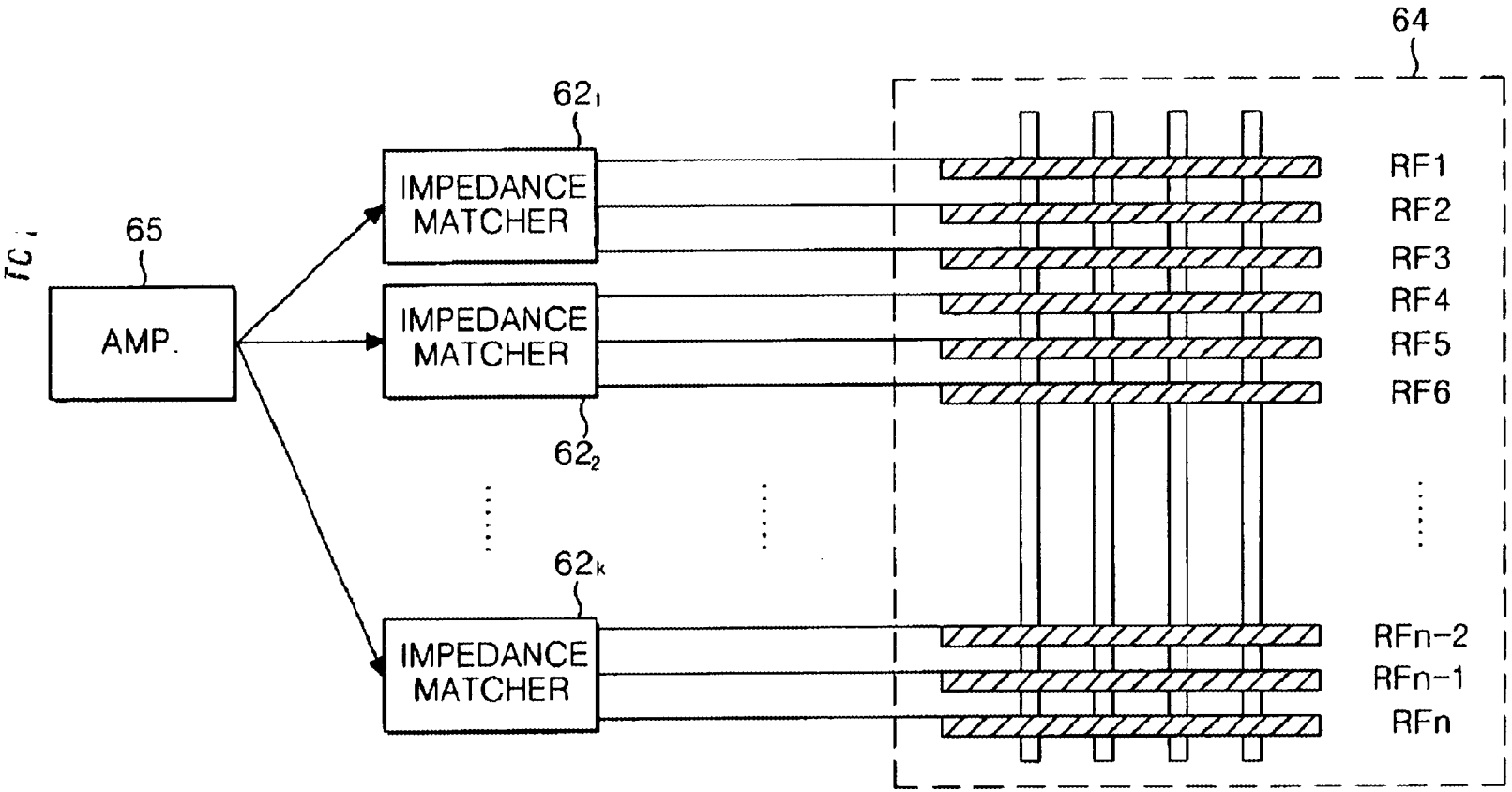
FIG. 7 is a block diagram showing the configuration of a driving circuit in a PDP according to another embodiment of the present invention.
Figure 8A:
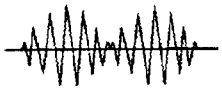
FIG. 8 is a view for explaining an impedance matching method applied to a driving circuit in a radio frequency PDP according to still another embodiment of the present invention.
Figure 8A:
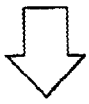
Figure 8B:
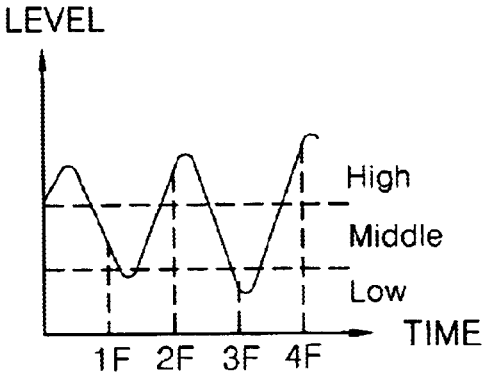
Figure 8C:
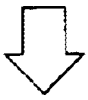

Referring to FIG. 7, there is shown a radio frequency driving circuit in a PDP according to another embodiment of the present invention. The radio frequency driving circuit has the same elements as that in FIG. 6 except that it includes a single amplifier 65 commonly connected to k impedance matchers $62_1$ to $62_k$ unlike the radio frequency driving circuit in FIG. 6. Accordingly, a detailed explanation as to the same elements will be omitted. The amplifier 65 is commonly connected to the to k impedance matchers $62_1$ to $62_k$. In this case, the length of supply lines between the amplifier 65 and each impedance matcher $62_1$ to $62_k$ becomes different to generate an impedance difference. The differentiated impedance can be compensated by each impedance matcher $62_1$ to $62_k$. In other words, each impedance matcher $62_1$ to $62_k$ is made into a different element value so that it can compensate for the length of radio frequency supply lines and the differentiated impedance. Accordingly, an impedance difference caused by a length difference in the supply lines is uniformly compensated by each impedance matcher $62_1$ to $62_k$, so that a maximum power of radio frequency signal can be applied to each radio frequency electrode line RF1 and RFn.

FIG. 8 is a view for explaining an impedance matching method to be applied a driving circuit for a radio frequency PDP according to still another embodiment of the present invention, which shows a process of detecting a brightness level of an image signal to convert it into a matching level.

Generally, a driving of the PDP requires a process of converting an input analog image signal into a digital image signal. In this case, a quantization factor of more than 256 levels is used. The radio frequency PDP driving circuit according to the present invention detects other separating signal for separating a plurality of levels in addition to a separating signal for separating a basic level 256 level for quantization. In other words, the radio frequency PDP driving circuit according to still anther embodiment of the present invention calculates a brightness level average value of image signals for each field (or frame) and separates the brightness level average value into three-step levels, that is, high ($H_L$), medium ($M_L$)and low ($L_L$) levels in accordance with a level magnitude. The brightness level average value separated into the first to third levels $H_L$, $M_L$ and $L_L$ is supplied to a signal processor after that time to be used for a bright correction and a matching correction. In FIG. 8, an analog image signal inputted as shown in (a) is sampled into a signal as shown in (b) to detect a brightness level and calculate an average value of the brightness level for each field or frame. The calculated brightness level average value is separated into the first to third levels $H_L$, $M_L$ and $L_L$ in accordance with its level to be used as an indicator for setting an impedance matching value to be corrected as shown in (c). The impedance matching value to be corrected also is separated into three-step levels $H_M$, $M_M$ and $L_M$ in correspondence with the three-step levels $H_L$, $M_L$ and $L_L$ of the brightness level average value. As described above, when the brightness level average value is detected for each frame, an impedance variation amount is forecasted to set a value to be corrected at the impedance matcher, so that the radio frequency PDP driving circuit can adaptively cope with a impedance change in the panel.

Figure 9:
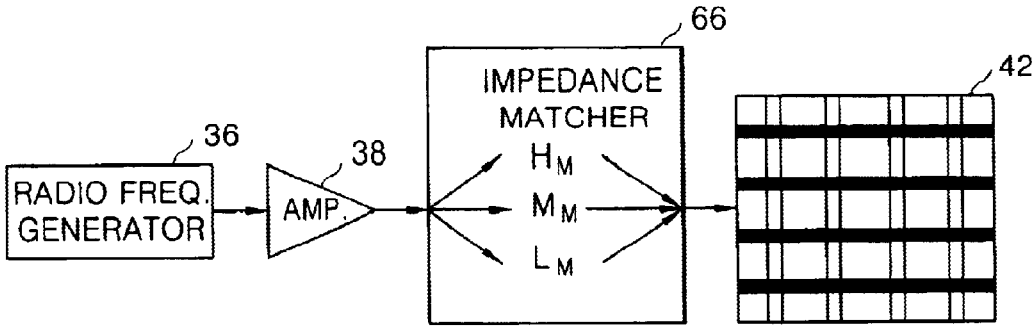
FIG. 9 is a block diagram showing the configuration of a radio frequency driving circuit included in the driving circuit of the radio frequency PDP according to still another embodiment of the present invention.
Figure 10:
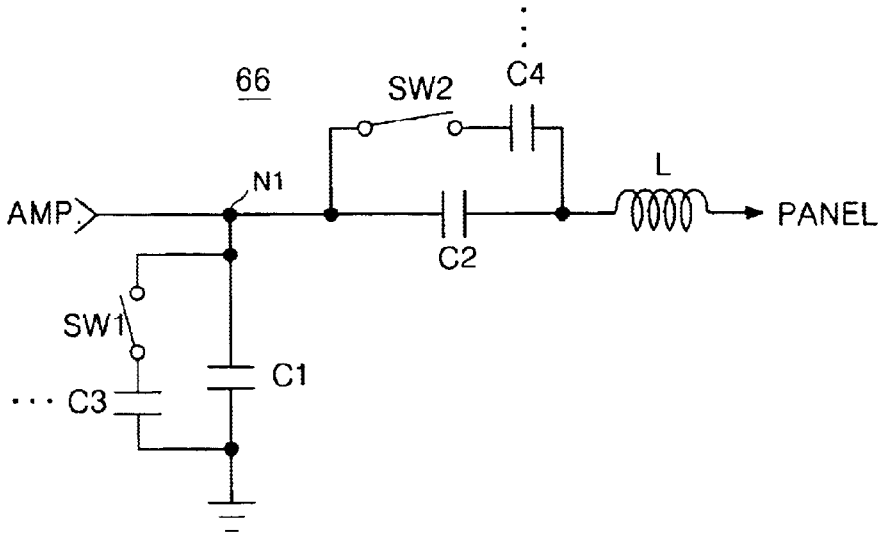
FIG. 10 is a detailed circuit of the impedance matcher shown in FIG. 9.

Referring now to FIG. 9, there is shown a radio frequency driving circuit included in a radio frequency PDP driving circuit according to still another embodiment of the present invention. The radio frequency driving circuit includes a radio frequency generator 36 for generating a radio frequency signal, an amplifier 38 for amplifying and outputting the radio frequency signal inputted from the radio frequency generator 36, and an impedance matcher 66 for matching impedance between the amplifier 38 and a panel 42 with a different matching value according to a correction value inputted from the exterior. The radio frequency generator 36 generates and outputs a radio frequency signal. The amplifier 38 amplifies sufficiently and outputs the radio frequency signal from the radio frequency generator 36. The impedance matcher 66 varies a matching value in accordance with a correction value inputted from the exterior to match impedance between the amplifier 38 and the panel 42, thereby applying a maximum power of radio frequency signal to the panel 42. In this case, the correction value inputted from the exterior can be three values $H_M$, $M_M$ and $L_M$ in correspondence with the first to third levels $H_L$, $M_L$ and $L_L$ of the brightness level average value as mentioned above. A method of varying a matching value at the impedance matcher 66 includes a method of making a different circuit configuration in accordance with a matching value using a switching system as shown in FIG. 10. In FIG. 10, the matcher 66 includes a first capacitor C1 connected between a first node N1 at an output terminal of the amplifier 38 and a ground, and a serial connection of a second capacitor C2 and an inductor L between the first node N1 and an input terminal of the panel 42. An impedance matching between the amplifier 38 and the panel 42 is made in accordance with values of the first and second capacitors C1 and C2 and the inductor L. The values of such passive elements C1, C2 and L are set to optimum values in accordance with impedance of the panel 42 and a characteristic of the PDP system. In order to provide a different matching value under exterior control, as shown in FIG. 10, a third capacitor C3 is connected, via a first switch SW1, to the first capacitor C1 in parallel, or a fourth capacitor C4 is connected, via a second switch SW2, to the second capacitor C2 in parallel. In this case, the number of capacitors connected, in parallel, to the first capacitor C1 and/or the second capacitor C2 is variable depending upon the number of correction levels.

Figure 11:
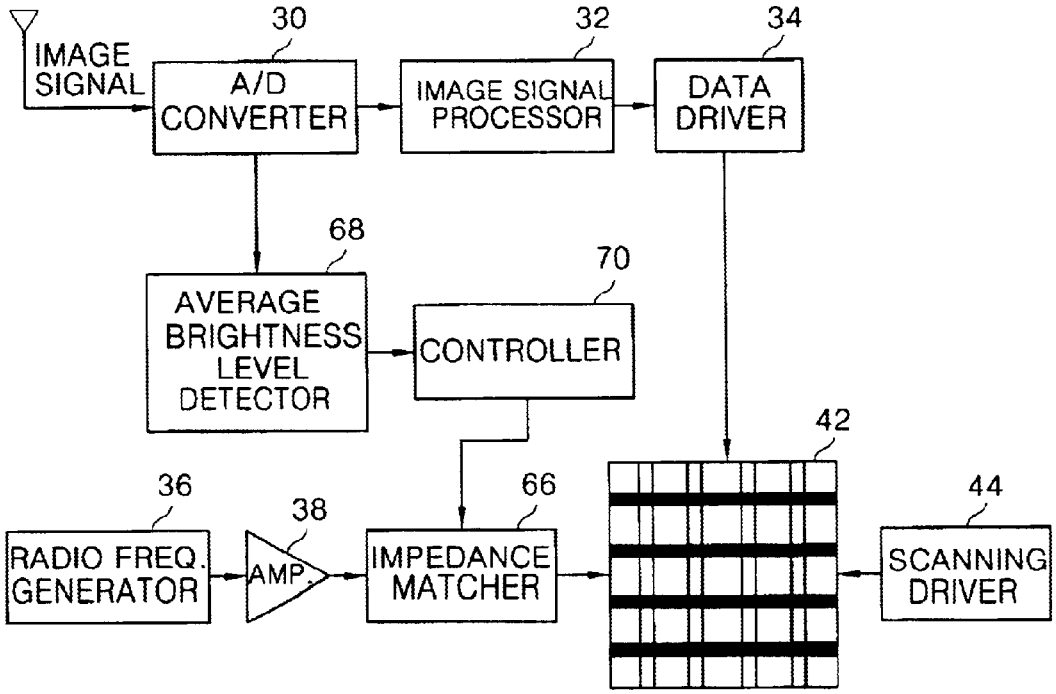
FIG. 11 is a block diagram showing the configuration of a driving circuit in a radio frequency PDP according to still another embodiment of the present invention.
Figure 12:
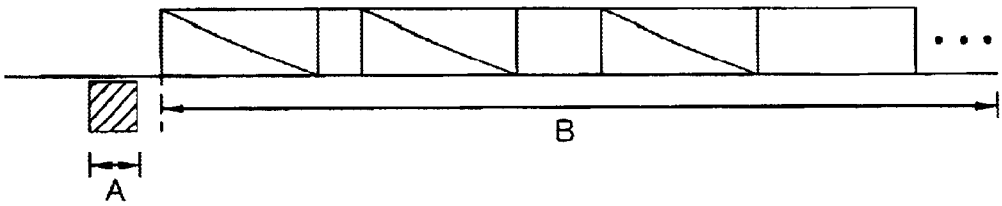
FIG. 12 is a timing diagram representing a compensation time of the impedance matcher in FIG. 11.

Referring to FIG. 11, there is shown a driving circuit for a radio frequency PDP including the radio frequency driving circuit shown in FIG. 9. The driving circuit includes an A/D converter 30 for converting an input analog signal into a digit signal, an image signal processor 32 for converting the digit signal from the A/D converter 30 into a bit data and re-arranging the bit data, a data driver 34 for outputting a driving signal according to the data signal inputted from the image signal processor 32 to the panel 42, an radio frequency generator 36 for generating a radio frequency signal, an amplifier 38 for amplifying and outputting the radio frequency signal from the radio frequency generator 36, an impedance matcher 66 for matching impedance between the amplifier 38 and the panel 42, a scanning driver 44 for driving scanning electrode lines of the panel 42, an average brightness level detector 68 for detecting a brightness average value using the digit signal from the A/D converter 30, and a controller 70 for controlling a matching value of the impedance matcher 66 in accordance with an average value of the average brightness level detector 68. The A/D converter 30 converts an input analog image signal into a digit signal and outputs the digit signal. The image signal processor 32 converts the digit signal from the A/D converter 30 into a bit signal to rearrange and output the bit signal in compliance with a driving of the panel 42. The data driver 34 applies a driving signal according to an image data inputted from the image signal processor 32 to data electrode lines of the panel 42. The scanning driver 44 applies a scanning signal to scanning electrode lines of the panel 42. The radio frequency generator 36 amplifies a radio frequency signal generated from the radio frequency generator 36 into enough a power to cause a radio frequency discharge and outputs the same to the impedance matcher 66. The impedance matcher 66 differentiates an impedance matching value under control of the controller 70 to match impedance between the amplifier 38 and the panel 42, thereby applying a maximum power of radio frequency signal to radio frequency electrode lines of the panel. The average brightness level detector 68 averages a digit signal inputted from the A/D converter 30 for each field or frame to detect an average brightness level. The controller 70 controls a matching value of the impedance matcher 66 in correspondence with the average brightness level from the average brightness level detector 68. In this case, the controller 70 controls the switches SW1, SW2, . . . of the impedance matcher 66 shown in FIG. 10 to adjust the matching value appropriately. A correction time A of the impedance matcher 66 can be set to just prior to a time interval for displaying an image in the corresponding field as shown in FIG. 12. This is possible because the average brightness level is detected prior to displaying the corresponding field at the PDP using the digit signal inputted, via the A/D converter 30, from the average brightness level detector 68, and because a matching value corresponding to the average brightness level has been already set at the controller 70. As described above, the PDP driving circuit controls impedance in accordance with a brightness level of an image signal every field to apply a maximum power of radio frequency signal to the panel 42, thereby providing a stable operation of the panel 42.

As described above, according to the present invention, a plurality of impedance matchers are included to uniformly compensate an impedance difference between the radio frequency electrode lines caused by a length difference of the radio frequency supply lines, so that a maximum power of radio frequency signal can be applied to each radio frequency electrode line. Accordingly, the PDP is capable of providing a stable radio frequency discharge to improve a picture quality. Furthermore, according to the present invention, a plurality of amplifiers and impedance matchers are included in such a manner to distribute a load quantity thereof, so that a voltage variation ratio of each of them gets better to provide a stable operation of the driving circuit. Moreover, according to the present invention, a plurality of amplifiers and impedance matchers are included in such a manner to have independent driving voltages for each group, so that it is easy to cope with a load quantity variation in the panel changing rapidly like a moving picture.

In addition, according to the present invention, a brightness level is detected for each field or frame to control the impedance matching value in accordance with the detected brightness level, so that a stable radio frequency signal can be applied to the panel. Accordingly, the radio frequency PDP can perform a stable radio frequency discharge.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving circuit for a plasma display panel using a radio frequency discharge, comprising:

a radio frequency generator which applies radio frequency signals to a plurality of radio frequency electrode lines;

one or more radio frequency amplifiers which amplify the radio frequency signals; and a plurality of impedance matching means for matching impedance between the amplified radio frequency signals and the plasma display panel, wherein the radio frequency electrode lines are divided into a plurality of groups and the plurality of impedance matching units have different impedance values in accordance with a length difference between radio frequency supply lines connected from the radio frequency generator to said groups.

2. The driving circuit as claimed in claim 1, wherein the plurality of radio frequency amplifiers are arranged independently of the plurality of impedance matching means.

3. The driving circuit as claimed in claim 1, further comprising:

a plurality of radio frequency amplifying means, being commonly connected to input terminals of the plurality of impedance matching means, to amplify and output an input radio frequency signal.

4. The driving circuit as claimed in claim 3, wherein said plurality of impedance matching means has a different element value in such a manner to compensate for impedance differentiated in accordance with a length difference in supply lines of the radio frequency signal.

5. The driving circuit as claimed in claim 1, wherein the detector detects the brightness level for each field or frame using the input image signal to calculate an average brightness level and output the same to the controller.

6. The driving circuit as claimed in claim 5, wherein the controller divides the average brightness level into a plurality of regions in accordance with a magnitude of the average brightness level and sets the impedance matching level in correspondence with the regions.

7. The driving circuit as claimed in claim 5, wherein the controller controls a switch included in the impedance matcher to adjust the impedance matching value of the impedance matching means.

8. A radio frequency driving circuit for a plasma display panel using a radio frequency discharge, comprising:

a radio frequency generator which applies radio frequency signals to a plurality of radio frequency electrode lines;

one or more radio frequency amplifiers which amplify the radio frequency signals;

impedance matching means for matching impedance between the amplified radio frequency signals and the plasma display;

a detector which detects a brightness level of an image signal input to the plasma display panel; and a controller which adjusts an impedance matching level of the impedance matcher in accordance with the detected brightness level.

9. A system for driving a plasma panel display, comprising:

a plurality of impedance matchers connected to respective ones of a plurality of RF electrodes in the plasma panel display, each of said impedance matchers matching an impedance of an input terminal with an impedance of a respective one of the RF electrodes; and a plurality of signal lines, each of said signal lines connecting one of said impedance matchers to a respective one of the RF electrodes, said signal lines have substantially a same length.

10. A system for driving a plasma panel display, comprising:

a plurality of impedance matchers connected to respective ones of a plurality of RF electrodes in the plasma panel display, each of said impedance matchers matching an impedance of an input terminal with an impedance of a respective one of the RF electrodes, wherein at least one of the impedance matchers matches impedance by an amount sufficient to allow a maximum signal to be input into a respective RF electrode.

11. A system for driving a plasma panel display, comprising:

a first impedance matcher connected to a first plurality of RF electrodes in the plasma display panel;

a second impedance matcher connected to a second plurality of RF electrodes in the plasma display panel, wherein said second plurality of RF electrodes are different electrodes from the first plurality of RF electrodes, and wherein the first impedance matcher matches an impedance of an input terminal with impedances of the first plurality of RF electrodes.

12. The system as claimed in claim 11, wherein the second impedance matcher matches an impedance of the input terminal with impedances of the second plurality of RF electrodes.

13. The system as claimed in claim 11, further comprising:

a first plurality of signal lines connecting the first impedance matcher with respective ones of the first plurality of RF electrodes, said first plurality of signal lines having substantially a same length.

14. The system as claimed in claim 13, further comprising:

a second plurality of signal lines connecting the second impedance matcher with respective ones of the second plurality of RF electrodes, said second plurality of signal lines having substantially a same length.

15. The system as claimed in claim 14, wherein the length of the first plurality of signal lines equals the length of the second plurality of signal lines.

16. The system as claimed in claim 11, further comprising:

an amplifier connected to the first impedance matcher and the second impedance matcher; and first and second lines connecting the amplifier to respective ones of the first impedance matcher and the second impedance matcher, wherein said first and second lines have different lengths, wherein said first impedance matcher and the second impedance matcher compensate for differences in impedances generated by the different lengths of the first and second lines.

17. A system for driving a plasma display panel, comprising:

an impedance matcher connected between an input terminal and the plasma display panel, said impedance matcher matching an impedance of the input terminal with an impedance of an RF electrode in the plasma display panel based on a brightness correction value.

18. The system as claimed in claim 17, wherein the brightness correction value is based on an average brightness of a plurality of image signals.

19. The system as claimed in claim 17, further comprising:

a brightness detection unit which compures the brightness correction value by classifying the average brightness into a plurality of categories corresponding to different levels of brightness.

* * * * *